US007009565B2

(12) United States Patent
Pidwerbetsky et al.

(10) Patent No.: US 7,009,565 B2
(45) Date of Patent: Mar. 7, 2006

(54) MINIATURIZED ANTENNAS BASED ON NEGATIVE PERMITTIVITY MATERIALS

(75) Inventors: Alex Pidwerbetsky, Randolph, NJ (US); Howard Roy Stuart, East Windsor, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 10/903,993

(22) Filed: Jul. 30, 2004

(65) Prior Publication Data

US 2006/0022875 A1 Feb. 2, 2006

(51) Int. Cl.
*H01Q 1/38* (2006.01)

(52) U.S. Cl. ..... 343/700 MS; 343/800; 343/771

(58) Field of Classification Search ..... 343/800, 343/771, 772

See application file for complete search history.

(56) References Cited

U.S. PATENT DOCUMENTS

| | | | | |
|---|---|---|---|---|
| 3,543,271 | A | 11/1970 | Scheel | 343/705 |
| 3,765,024 | A | 10/1973 | Chiron | 343/854 |
| 4,090,198 | A | 5/1978 | Canty et al. | 343/18 |
| 6,002,368 | A | 12/1999 | Faraone et al. | 343/700 |
| 6,046,701 | A | 4/2000 | Carey et al. | 343/753 |
| 6,147,647 | A * | 11/2000 | Tassoudji et al. | 343/700 MS |
| 6,344,833 | B1 * | 2/2002 | Lin et al. | 343/846 |
| 6,424,319 | B1 | 7/2002 | Ebling et al. | 343/911 |
| 6,433,649 | B1 * | 8/2002 | Miura et al. | 333/1.1 |
| 6,473,050 | B1 | 10/2002 | Foncin | 343/754 |
| 6,661,392 | B1 * | 12/2003 | Isaacs et al. | 343/911 R |

OTHER PUBLICATIONS

Johnson, R.C., "*Metamaterial' holds promise for antennas, optics,*" EE Times, URL: http://www.eetimes.com/story/OEG20010430S0110, 2 pages, Apr. 30, 2001.

Smith, D.R., et al., "*Composite Medium with Simultaneously Negative Permeability and Permittivity,*" Physical Review Letters, vol. 84, No. 18, pp. 4184-4187, May 1, 2000.

Shelby, R.A., et al., "*Microwave transmission through a two-dimensional, isotropic, left-handed metamaterial,*" Applied Physics Letters, vol. 78, No. 4, pp. 489-491, Jan. 22, 2001.

Shelby, R.A., et al., "*Experimental Verification of a Negative Index of Refraction,*" Science. vol. 292, pp. 77-79, Apr. 6, 2001.

Smith, D.R., et al., "*Loop-wire medium for investigating plasmons at microwave frequencies,*" Applied Physics Letters, vol. 75, No. 10, pp. 1425-1427, Sep. 6, 1999.

Smith, D.R., et al., "*Negative Refracative Index in Left-Handed Materials,*" Physical Review Letters, vol. 85, No. 14, pp. 2933-2936, Oct. 2, 2000.

(Continued)

*Primary Examiner*—Trinh Vo Dinh
(74) *Attorney, Agent, or Firm*—M. I. Finston

(57) ABSTRACT

An antenna comprises a resonator and a waveguide. The resonator comprises at least one body having a negative effective electrical permittivity or a negative magnetic permeability when a resonance is excited therein by electromagnetic radiation lying in some portion of the microwave spectrum. A termination of the waveguide is situated adjacent the resonator. The resonator is conformed such that at the resonance, there is efficient coupling between the resonator and the waveguide.

17 Claims, 4 Drawing Sheets

OTHER PUBLICATIONS

Smith, D.R., et al., "*Direct calculation of permeability and permittivity for a left-handed metamaterial,*" Applied Physics Letters, vol. 77, No. 14, pp. 2246-2248, Oct. 2, 2000.
Pendry, J.B., et al., "*Extremely Low Frequency Plasmons in Metallic Mesostructures,*" Physical Review Letters, vol. 76, No. 25, pp. 4773-4776, Jun. 17, 1996.
"Meta-Materials Workshop", announcement in *Commerce Business Daily* issue of Aug. 21, 2000, PSA #2668.
UCSD Press Release, UCSD, "*Physicists Develop New Class of Composite Materials with 'Reversed 'Physical Properties Never Before Seen,*" Press Conference, Minneapolis, MN, Mar., 2001, 3 pages.
"*Left-Handed Materials,*"http://physics.ucsd.edu/~drs, 3 pages.

* cited by examiner

MINIATURIZED ANTENNAS BASED ON NEGATIVE PERMITTIVITY MATERIALS

FIELD OF THE INVENTION

The invention relates to antennas, and more particularly to miniature antennas for microwave transmission and reception.

ART BACKGROUND

Conventional antennas often have linear dimensions comparable to the wavelength of the radiation being received or transmitted. For example, a typical radio transmitter uses a dipole antenna whose length is about one-half the wavelength of the waves being transmitted. Such an antenna length provides for efficient coupling between the antenna's electrical driver and the radiation field.

However, antennas having linear dimensions comparable to the radiation wavelength are not practical in all situations. In particular, cellular telephones and handheld wireless devices are small. Because such devices provide limited space for antennas, it would be advantageous to equip them with miniaturized antennas. Unfortunately, simply reducing antenna size without deviating from conventional principles leads to small antennas that couple inefficiently to the radiation at the wavelengths typically used in cellular telephones and handheld wireless devices.

U.S. Pat. No. 6,661,392, which issued to Isaacs et al. on Dec. 9, 2003, describes an antenna that resonantly couples to external radiation at communication frequencies even with linear dimensions much smaller than one-half the radiation wavelength. Due to the resonant coupling, the antenna is very sensitive to the radiation.

The antenna includes a resonant object formed of a special material, such as a manmade metamaterial, whose electrical permittivity or magnetic permeability has, in effect, a negative real part at microwave frequencies. One or more sensors located adjacent to or in the object measure an intensity of an electric or a magnetic field therein.

Although antennas based on such special materials have promise, improvements in bandwidth and waveguide coupling efficiency are needed in order for the performance of such antennas to be improved to the fullest possible extent.

SUMMARY OF THE INVENTION

An antenna according to the present invention includes a resonant body fabricated of a material whose electrical permittivity or magnetic permeability is negative, or of a manmade metamaterial which emulates such behavior, over a range of communication frequencies. The, e.g., metamaterials are selected to cause the antennas to couple resonantly to external radiation at specified communication frequencies in, e.g., the range 0.1 GHz to 10 THz, and particularly in the range of microwave frequencies between about 1 GHz and about 100 GHz. Due to the resonant coupling, the antennas have high sensitivity to the radiation even though their linear dimensions are much smaller than the wavelength of the radiation.

The resonant coupling results from selecting the metamaterial to have appropriate effective permittivity or permeability values. An appropriate selection of the metamaterial depends on the shape of the object and the frequency range over which a resonant response is desired. Theory shows that for spherical antennas, for example, the permittivity or permeability of an idealized material advantageously has a real part near −2 in a frequency range of interest. For such values, a spherical antenna is very sensitive to external radiation even if its diameter is much smaller than one-half the radiation wavelength.

Accordingly, the invention in one aspect involves an antenna which is meant to operate in a range of frequencies including a resonant frequency $f_{res}$ of the antenna. A vacuum wavelength $\lambda_{res}$ corresponds to electromagnetic radiation at the resonant frequency. The antenna includes a resonator coupled to a transmission line. The resonator comprises a patterned structure, or a shaped material which has negative electric permittivity or magnetic permeability. The maximum spatial extent of the resonator is less than one-half $\lambda_{res}$. The resonator is effective for supporting a resonance, and for coupling to an external radiation field such that the resonant scattering cross-section of the resonator is greater than or equal to approximately $0.3\lambda_{res}^2$ for at least one incident polarization and direction of electromagnetic radiation. The transmission line is coupled to the resonator such that when the resonator is driven at $f_{res}$ by a driving signal in the transmission line, there is at least 10 dB of return loss in the transmission line.

BRIEF DESCRIPTION OF THE DRAWING

FIGS. 1 and 2 are not drawn to scale.

FIG. 7 is not drawn to scale.

DETAILED DESCRIPTION

Figure 1:
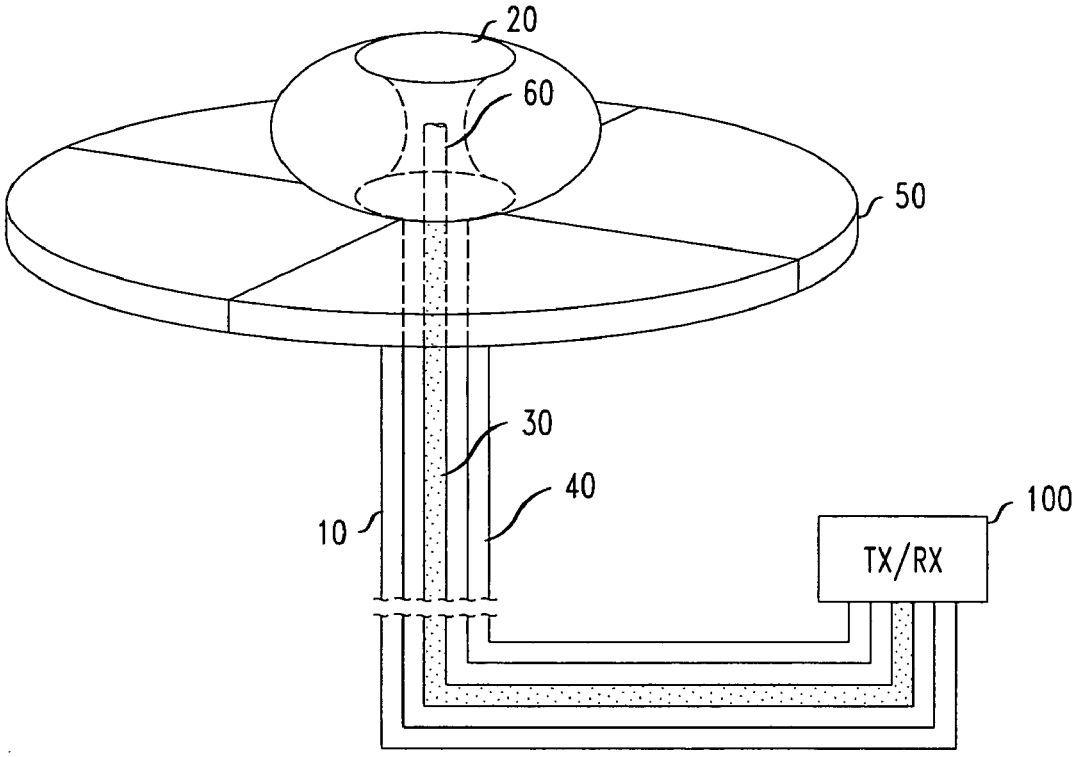
FIG. 1 shows an antenna arrangement according to an exemplary embodiment of the invention in which a coaxial transmission line is coupled to a toric resonator having a negative electrical permittivity in a frequency range of interest.

Although no naturally occurring materials are known that exhibit negative electrical permittivity or negative magnetic permeability at microwave frequencies, such behavior can be made to occur over a limited frequency range in artificial materials such as so-called structured dielectrics, also referred to as metamaterials. Typical metamaterials are constructed from periodic arrays of wires or metal plates. Negative permittivity has also been observed in plasmas having certain charge densities.

Some such metamaterials having properties which may be useful in the present context are described in R. A. Shelby et al., "Experimental Verification of a Negative Index of Refraction", *Science* 292 (2001) 77. Various designs for such metamaterials are provided in D. R. Smith et al., "Composite Medium with Simultaneously Negative Permeability and Permittivity", *Physical Review Letters* 84 (2000) 4184 and R. A. Shelby et al., "Microwave transmission through a two-dimensional, isotropic, left-handed metamaterial", *Applied Physics Letters* 78 (2001) 489. Exemplary designs produce metamaterials having permittivities, permeabilities, or both, with negative values at frequencies in the ranges of about 4.7–5.2 GHz and about 10.3–11.1 GHz.

Various designs for 2- and 3-dimensional manmade objects of metamaterials include 2- and 3-dimensional arrays of conducting objects. Various embodiments of the objects include single and multiple wire loops, split-ring resonators, conducting strips, and combinations of these objects. The exemplary objects made of single or multiple wire loops have resonant frequencies that depend in known ways on the parameters defining the objects. The effective electrical permittivities and magnetic permeabilities of the metamaterials depend on both the physical traits of the objects therein and the layout of the arrays of objects. For wire loop objects, the resonant frequencies depend on the wire thickness, the loop radii, the multiplicity of loops, and the spacing of the wires making up the loops. See e.g.,; "Loop-wire medium for investigating plasmons at microwave frequencies", D. R. Smith et al., *Applied Physics Letters* 75 (1999) 1425.

It has been found that localized plasma resonances in negative permittivity materials can couple strongly to radiating electromagnetic fields even when the resonating structures are smaller in spatial extent than one vacuum wavelength of the radiating field. (Such structures are referred to here as "subwavelength" structures.)

At the frequencies of interest, the permittivity in the materials of interest is dependent on the frequency of the electromagnetic field. For example, at least some negative permittivity materials are modeled by an expression of the form $$\varepsilon(\omega) = 1 - \frac{\omega_p^2}{\omega(\omega + i\gamma)},$$

in which $\epsilon(\omega)$ is the permittivity as a function of frequency $\omega$, $\omega_p$ is the plasma frequency of the material, and $\gamma$ represents loss. We refer to this expression as a "permittivity dispersion relation." In at least certain structures, strong plasma resonances are predicted at those frequencies for which the permittivity lies near −2. For example, resonance is predicted for subwavelength spheres near frequencies $\omega$ for which $\epsilon(\omega)=-2$, and for cylinders of infinite length and subwavelength radius near frequencies $\omega$ for which $\epsilon(\omega)=-1$.

Importantly, theoretical studies predict that at resonance, the electromagnetic scattering cross section of a lossless negative permittivity sphere whose diameter is much smaller than one wavelength will be fixed at $$\frac{3}{2\pi}\lambda^2$$

even when the sphere is vanishingly small. Thus, anomalously strong coupling to radiative fields is predicted for small bodies behaving as antennas. We believe that a range of subwavelength structures having non-spherical geometries and moderate amounts of loss will also exhibit such anomalous coupling behavior if there is negative permittivity. Detailed calculations have confirmed this belief for at least one such structure, as will be explained below.

One feature that is important for characterizing the performance of an antenna is the bandwidth or the Q factor of the antenna. (The bandwidth, expressed as a percentage of the resonant frequency, is $$\frac{1}{Q} \times 100\%.$$

If the bandwidth is too small (Q is too high), the antenna may be ineffective for transmitting or receiving in more than a portion of a desired communication band. It is well known from conventional antenna theory that, for antennas much smaller than the wavelength, the minimum achievable Q of the antenna varies inversely with the cube of the radius of the smallest sphere enclosing the entire antenna; thus, as the radius decreases, the resonance bandwidth also decreases. Furthermore, most conventional antenna designs are not optimized to achieve this minimum value of Q, and tend to perform substantially worse than this fundamental limit. However, for radii much less than one wavelength, the theoretical Q of a lossless negative permittivity sphere is only a factor of 3/2 greater than the fundamental lower limit. This suggests that negative permittivity spheres will have particularly good bandwidth performance (relative to the fundamental limit) when utilized as small antennas, and furthermore that, for resonant geometries other than a sphere, the use of negative permittivity structures as resonators will provide improved bandwidth performance relative to conventional antenna designs of the same size.

Material loss, i.e., dissipation of electromagnetic energy within the antenna material, is another feature that should be considered in antenna design. In general, the permittivity is a complex number, i.e., $\epsilon=\epsilon_r+i\epsilon_i$, wherein $\epsilon_r$ and $\epsilon_i$ are real numbers denoting, respectively, the real and imaginary parts of the permittivity. When the permittivity is said to be "negative," what is meant is that $\epsilon_r$ is negative. Material loss is characterized by $\epsilon_i$. Although some loss may lead to a beneficial broadening of the resonance bandwidth of the antenna, there is a tradeoff because loss also decreases the scattering efficiency of the antenna.

The scattering efficiency $\eta$ is defined as the ratio of the scattering cross section to the sum of the scattering and absorption cross sections. Although the specific scattering efficiency needed for an antenna to be useful depends on the specific application and may in some cases be quite low, it is generally desirable for the scattering efficiency to be at least 50%.

For a resonant subwavelength sphere as described above, the theoretical scattering efficiency is given by $$\eta = \frac{1}{1 + \frac{1}{2} \cdot \frac{\varepsilon_i}{(2\pi r/\lambda)^3}},$$

in which r is the radius of the sphere and $\lambda$ is the vacuum wavelength corresponding to frequency $\omega$. It will be seen that as the radius of the sphere is reduced, the scattering efficiency decreases, and that for very small radii, the theoretical scattering efficiency varies as $r^3$.

According to the model described above, to maintain a scattering efficiency above 50%, a resonant sphere with $r/\lambda=0.1$ would need $\epsilon_i<0.5$ and a resonant sphere with $r/\lambda=0.05$ would need $\epsilon_i<0.06$.

For the radiant structure to function as a useful antenna, it should be able to convert, with relatively high efficiency, between guided waves in a transmission line or other waveguiding structure, and radiating waves in free space. It should be noted in this regard that both operation in transmission and operation in reception are envisaged. In transmission, conversion is from the guided wave to the wave radiating in free space, and conversely for reception.

FIG. 1 shows an exemplary arrangement in which coaxial transmission line 10 is coupled to resonator 20. The resonator in this example is a torus of negative permittivity material having a plasma frequency of 3.5 GHz. The minor diameter of the torus (i.e., the diameter of the circle that generates the torus) is 16 mm. The major diamter of the torus (the diameter of the path traced out by the center of the generator circle) is 19 mm. The coaxial transmission line has an impedance of 50 Ω. Center conductor 30 of the transmission line is 3 mm in diameter and outer conductor 40 is 7 mm in diameter. Ground plate 50 is electrically continuous with outer conductor 40 and extends in the dimensions transverse to the transmission line so as to define a ground plane.

Stub 60 is a short straight portion of center conductor 30 that extends above plate 50 (as seen in the figure) in the direction perpendicular thereto. Stub 60 is electrically insulated from plate 50.

The symmetry axis of torus 20 is collinear with that of stub 60. The distance of closest approach between torus 20 and plate 50 is 1.5 mm, and the distance of closest approach between the torus and stub 60 is also 1.5 mm.

In a series of numerical simulations which are described in more detail below, we varied the length of stub 60 to find that length which gave optimum coupling between the transmission line and the antenna structure. We found an optimum stub length of about 10 mm, which was approximately one-fourteenth the vacuum wavelength of radiation at the resonant frequency.

For our numerical simulations, we chose resonator 20 to be toric in shape for two reasons: the torus provides good modal overlap between the transmission line and the resonator, and the axial symmetery of the torus simplifies the numerical modeling calculations. Therefore, it should be noted that effective resonators are likely to be found in other configurations, including those that lack axial symmetry, so long as good modal overlap is provided. One configuration of interest, for example, is a spherical resonator offset a small distance from the stub.

In at least some cases, it will also be advantageous to configure a resonator as a collection of two or more separate but electromagnetically coupled bodies.

Figure 2:
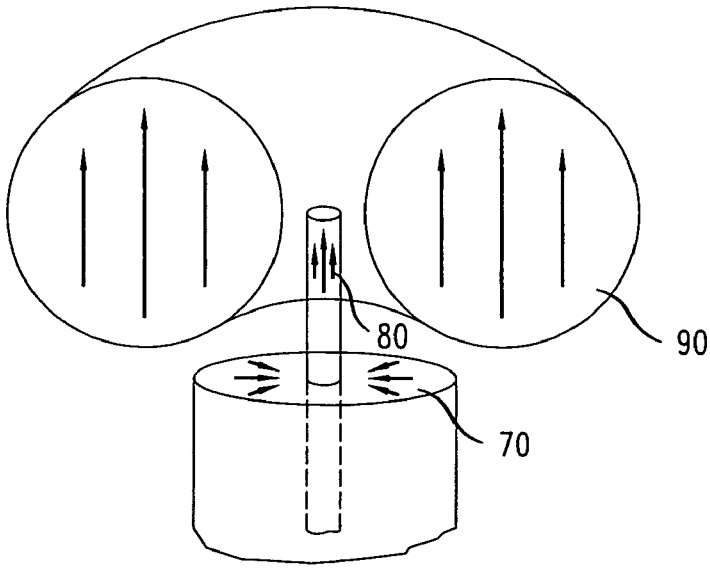
FIG. 2 shows, conceptually, the symmetry properties of the electric field profiles, at resonance, in respective cross sections of the transmission line and the resonator of FIG. 1.

In regard to modal overlap, reference is made to FIG. 2, which indicates the symmetry properties of electric field mode profiles 70, 80, 90 of the coaxial transmission line, the stub, and the toric resonator body, respectively. The corresponding symmetries seen in the stub and in the resonator are predictive of strong coupling between these elements.

In our numerical simulations, we assumed that the permittivity of the resonator varied with frequency according to the permittivity dispersion relation specified above. As noted, the toric structure was adopted partly to afford good modal overlap with the stub. The amount of modal overlap was estimated by well-known quasi-static techniques of electric field analysis. It should be noted in this regard that localized plasmon resonances, such as are expected in our resonator structures, have electric field profiles that are uniform across the resonating structure.

In our numerical simulations, we considered two hypothetical values for the loss coefficient $\gamma$: $\gamma=0$ and $\gamma=0.02\omega_p$, in which $\omega_p$ is the plasma frequency of the resonator. In each case, we launched an incident wave into the transmission line and measured (through simulations) the return loss in the transmission line. A large negative value of the return loss in decibels signifies that power has been efficiently coupled from the transmission line to the resonator, and from the resonant plasmon mode to radiating modes in free space.

Figure 3:
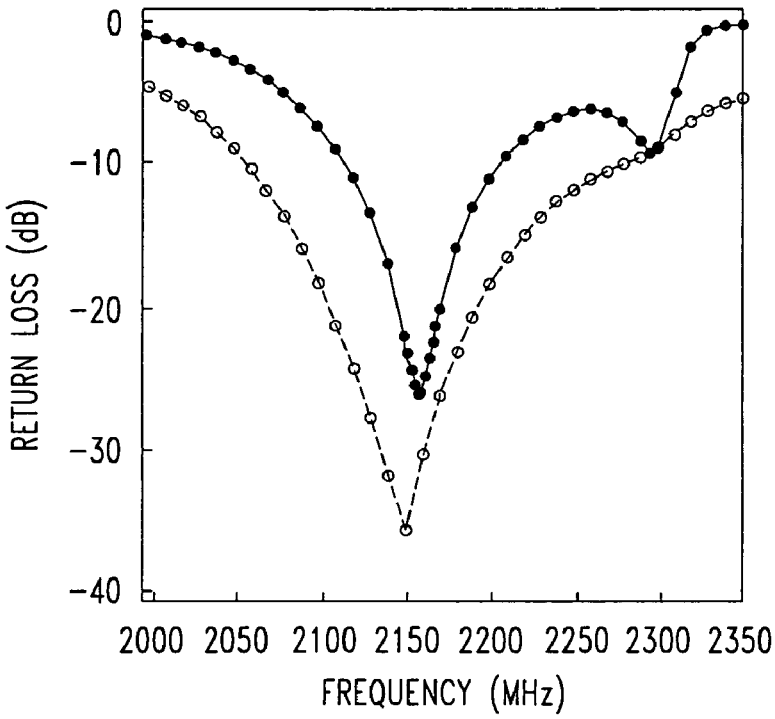
FIG. 3 is a graph of the return loss versus frequency for the antenna structure of FIG. 1.

FIG. 3 is a graph of the return loss versus frequency for the antenna structure of FIG. 1. Along the vertical axis of the graph, return loss is plotted in negative decibels to indicate that the back-reflected power in the transmission line is smaller than the injected power. In our discussion below, however, we will describe the loss in terms of its magnitude; i.e., as a positive number. The stub length was optimized to 10 mm for the lossless resonator (solid curve in the figure), and to 9.5 mm for the resonator with loss (broken curve in the figure). It will be seen that both with and without loss, there is a strong resonance at $\omega$ of about 2160 MHz. The return loss at resonance is seen to be about 27 dB for the lossless resonator and about 36 dB for the lossy resonator. It will be understood from these values that there is efficient coupling of the injected microwave power into radiating modes. This implies, among other things, that an effective impedance match is achieved between the 50 Ω transmission line and the resonator. At resonance, the antenna with loss had a calculated bandwidth of about 10% and a calculated antenna efficiency of about 40%.

Figure 4:
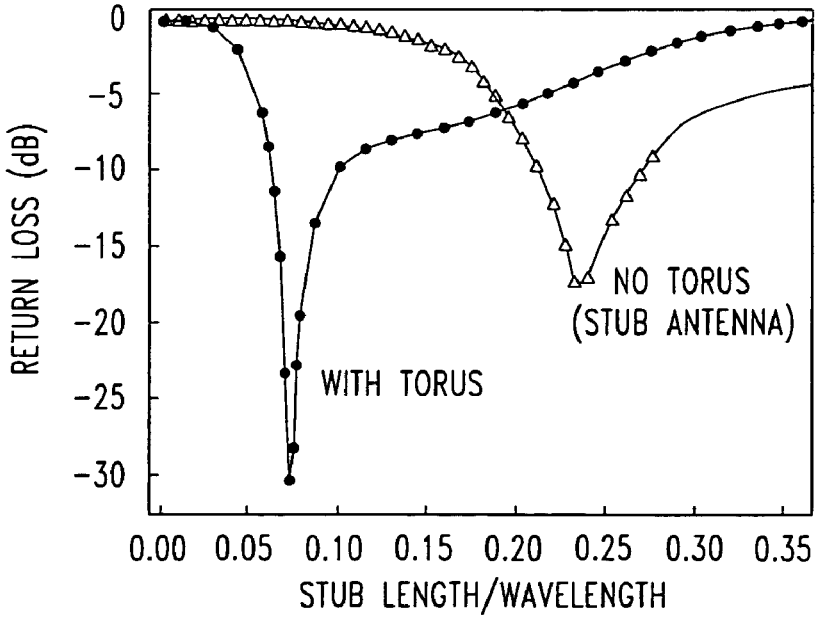
FIG. 4 shows a graph of the return loss versus stub length for the antenna structure of FIG. 1 with a lossless resonator at a fixed frequency of 2160 MHz. For comparison, the figure also shows a graph of return loss versus stub length for a stub antenna without a resonator.
Figure 5A:
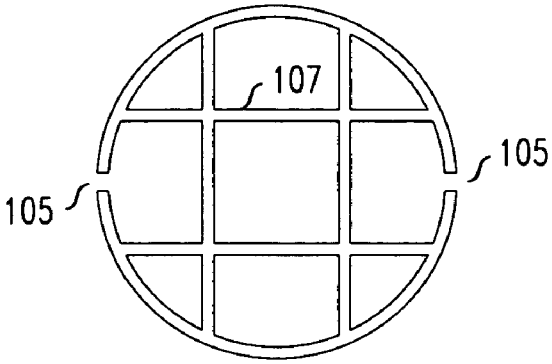
FIGS. 5A–5E represent illustrative implementations of a ring-shaped resonator in a planar geometry.
Figure 5B:
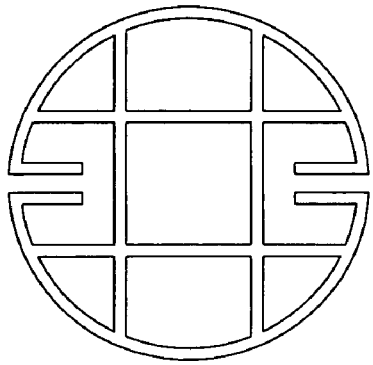
Figure 5C:
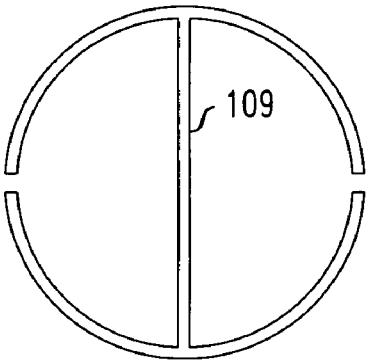
Figure 5D:
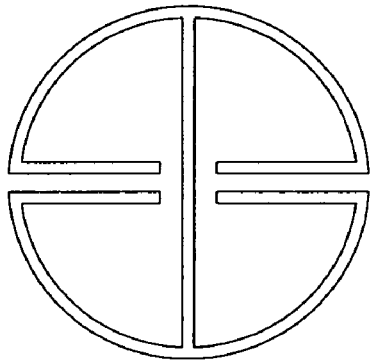
Figure 5E:
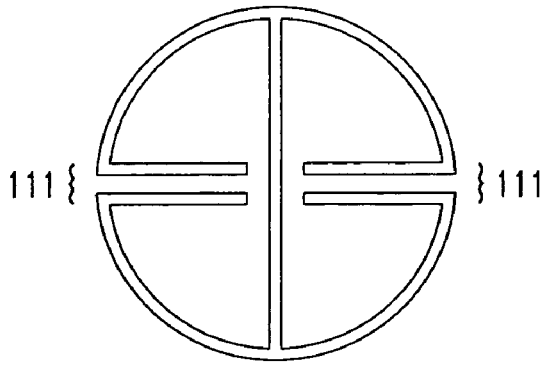

FIG. 4 shows a graph of the return loss versus stub length for the antenna structure of FIG. 1 with a lossless resonator and a fixed frequency of 2160 MHz. The stub length is expressed as the dimensionless ratio of stub length to wavelength. The curve exhibits a sharp peak in the loss, at a normalized stub length of about 0.075. The peak return loss is about 30 dB. For comparison, FIG. 4 also shows a graph of return loss versus stub length for a stub antenna without a resonator. The second curve shows a shallower and broader peak in the loss at a normalized stub length of about 0.24. The peak return loss is about 18 dB.

The results shown in FIG. 4 indicate that the presence of the toric resonator made it possible to significantly shorten the length of the stub. In our specific example, the stub was shortened by more than a factor of three. Moreover, the presence of the resonator led to better impedance matching between the 50 Ω transmission line and the radiating antenna structure at the resonant frequency.

Our simulations also showed that a stub of optimal length extends about halfway into the toric resonator. Our simulations also showed that varying the distance of closest approach of the torus to the stub and ground plate shifts the resonant frequency to lower values as the distance decreases.

Our simulations showed that when operated in transmission, the antenna structure of FIG. 1 has, at resonance, an antenna pattern that corresponds to the radiated field of a vertical oscillating dipole.

The return loss of an antenna fed by a transmission line is readily measured by connecting a network analyzer to the transmission line and using the network analyzer to measure, versus frequency, the relative amount of power incident on the antenna that is reflected back into the transmission line.

In general, an antenna according to the principles described herein will be useful for at least some applications if it exhibits a return loss of magnitude greater than about 10 dB. If the return loss is substantially less than 10 dB, too little microwave power will be coupled into the antenna (for transmission) or out of the antenna (for reception) to be useful for any applications other than some specialized applications. From our numerical modeling, we believe that, surprisingly, return losses of 10 dB and more can be realized in antenna structures of subwavelength dimensions.

Turning back to FIG. 1, it will be seen that at the end opposite to the antenna, transmission line 10 terminates at circuit 100. If the antenna is to be used for transmission, circuit 100 includes a source of radiofrequency signals, such as microwave signals, for transmission. If the antenna is to be used for reception, circuit 100 includes receiver circuitry for radiofrequency signals such as microwave signals.

In one embodiment, a resonator of the kind discussed here is implemented using an actual plasma with a plasma frequency determined by the charge density n of the plasma according to the well-known equation $$\omega_p^2 = \frac{4\pi ne^2}{m},$$

where e and m are the electric charge and mass of the individual charge elements of the plasma. This can be achieved, for example, using a conventional gas-discharge tube, or alternatively, using semiconductors where the individual charge elements are introduced by doping or carrier injection (electrical or optical).

Because of the strict dependence of the plasma frequency on charge density, not all frequency ranges of interest may be available using an actual plasma as described above. For example, achievable dopant levels in semiconductors result in plasma frequencies that are at minimum several hundred gigahertz. However, as noted above, other embodiments can utilize the ability of structured dielectrics to emulate the behavior of negative permittivity materials.

FIGS. 5A–5E show examples of ring-shaped resonant structures implemented using patterned electrical conductors such as metallization patterns disposed on a planar substrate surface. Such structures are conformed, e.g., as split rings having paired, diametrically opposed gaps 105. Such structures may include outer rings and features within the rings such as grid 107, diametrical crossbar 109, or infolded gap structure 111, which is formed by extending gap 105 partway toward the center of the ring in a bilaterally symmetric manner.

Figure 6:
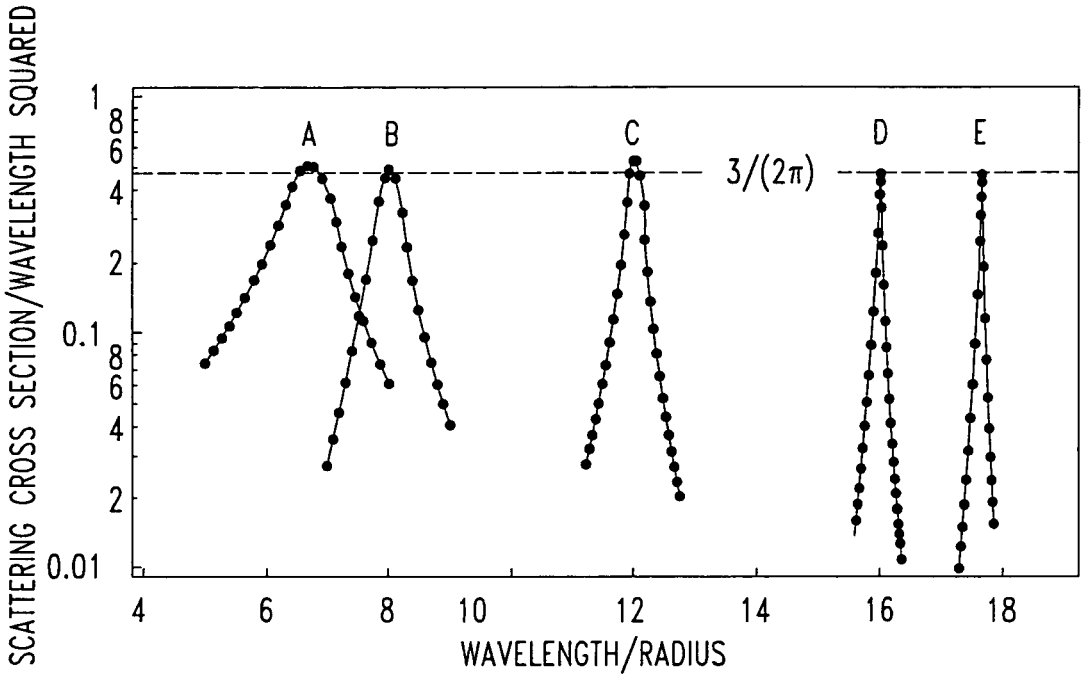
FIG. 6 is a graph of the scattering cross section versus excitation wavelength for each of the resonators of FIG. 5. On the horizontal axis of the graph, wavelength is normalized to the radius of the resonant ring. The detail labeled "A" in the figure corresponds to the resonator of FIG. 5A. Correspondences are similar for the details labeled B–D and FIGS. 5B–5E, respectively.

FIG. 6 shows the respective scattering cross-sections of the resonator structures of FIGS. 5A–5E in the form of scattering spectra. The resonator structures shown in the figures are made using, e.g., conventional printed circuit board manufacturing techniques to pattern a thin conducting layer into any of various shapes.

The scattering spectra of FIG. 6 demonstrate that each resonator achieves a resonant scattering cross-section of $$\frac{3}{2\pi}\lambda^2,$$

even though the radii of these structures range from 0.15 to 0.057 times the exciting wavelength at resonance. These resonators therefore emulate the electromagnetic response of negative permittivity resonators, and can be used in lieu of actual negative permittivity materials to achieve the desired behavior at the frequencies of interest. It should be noted that although the exemplary resonators shown in FIGS. 5A–5E are planar and circular in shape, the principles illustrated here can also be applied in non-planar geometries and in resonator structures having a wide range of potential shapes. A particular example of a non-planar geometry of interest is a stack of two or more electromagnetically coupled resonator bodies disposed on surfaces lying in distinct parallel planes.

Figure 7:
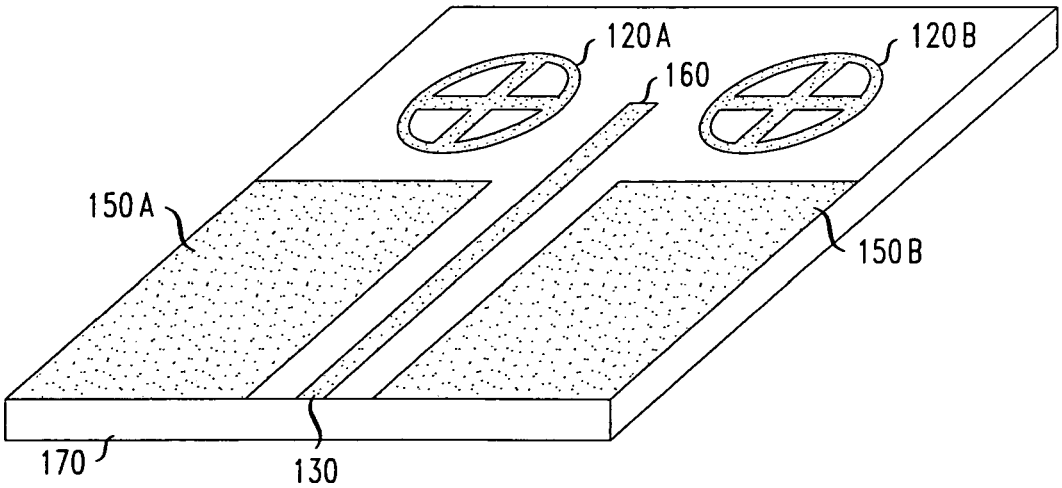
FIG. 7 is a schematic drawing of an antenna according to the invention, implemented in a planar geometry.

FIG. 7 shows an illustrative antenna implementation in a planar geometry. As seen in the figure, the antenna includes resonator structures 120A and 120B, which are patterned conductors such as those illustrated in FIGS. 5A–5E. A transmission line is defined by center conductor 130 and ground half-planes 150A and 150B. Conductor 130 is insulated from the ground half-planes and lies between them, except for stub 160, which extends beyond the ground half-planes and into the space between the resonator structures. It will be understood that structures 120A and 120B are analogous to toric resonator 20 of FIG. 1, that stub 160 is analogous to stub 60 of FIG. 1, and that ground half-planes 150A and 150B are analogous to ground plane 50 of FIG. 1. As noted, conventional fabrication techniques for printed circuit boards are readily employed to form features 120A, 120B, 130, 150A, 150B, and 160 on insulative substrate 170.

We have described exemplary embodiments of the invention in which the resonator is made from a material that exhibits negative effective electrical permittivity. As noted, other embodiments can be made which instead rely upon material exhibiting negative magnetic permeability. Such embodiments are also considered to lie within the scope and spirit of the present invention.

What is claimed is:

1. An apparatus comprising an antenna for operation in a range of frequencies including a resonant frequency $f_{res}$ of the antenna associated with a vacuum wavelength $\lambda_{res}$ of electromagnetic radiation, the antenna comprising:

a) at least one resonator of the kind in which a patterned structure, or a shaped material of negative electric permittivity or magnetic permeability, has maximum spatial extent less than one-half $\lambda_{res}$ and is effective, at least at $f_{res}$, for:

i) supporting a resonance, and ii) coupling to an external radiation field such that the resonant scattering cross-section of the resonator is at least about $0.3\lambda_{res}^2$ for at least one incident polarization and direction of electromagnetic radiation; and b) a transmission line coupled to the resonator such that when the resonator is driven at $f_{res}$ by a driving signal in the transmission line, such portion of the driving signal as reflects back into the transmission line does so with a return loss of at least 10 dB.

2. The apparatus of claim 1, wherein the transmission line comprises at least two conductors and has an end proximate the resonator, and one of said conductors terminates in a stub which extends beyond the end of the transmission line and lies adjacent the resonator.

3. The apparatus of claim 2, wherein the transmission line has a center conductor and a ground conductor coaxial with the center conductor, the stub is continuous with the center conductor, and the stub and the transmission line lie on opposing sides of a planar conductive region that extends substantially perpendicularly to the transmission line and is electrically continuous with the ground conductor.

4. The apparatus of claim 3, wherein the resonator comprises a toral body aligned coaxially with the stub.

5. The apparatus of claim 2, wherein the transmission line is disposed on a planar surface.

6. The apparatus of claim 5, wherein the transmission line comprises a center conductor disposed between two ground conductors, and the stub is continuous with the center conductor.

7. The apparatus of claim 6, wherein the resonator comprises at least one metallization pattern disposed on a planar surface.

8. The apparatus of claim 7, wherein the metallization pattern comprises at least one pair of resonant structures disposed symmetrically about the stub.

9. The apparatus of claim 7, wherein at least one said metallization pattern is coplanar with the transmission line.

10. The apparatus of claim 7, wherein the resonator comprises a stack of two or more metallization patterns occupying different planes.

11. The apparatus of claim 7, wherein at least one said metallization pattern comprises a ring-shaped structure.

12. The apparatus of claim 1, further comprising a ground plate situated adjacent the resonator, and wherein:

the transmission line is a coaxial cable having an inner and an outer conductor, and the outer conductor is electrically continuous with the ground plate;

the coaxial cable and the resonator lie on opposite sides of the ground plate;

proximate the resonator, the coaxial cable is terminated by a stub which is continuous with the inner conductor, said stub projecting through and beyond the ground plate such that at least a portion of the stub lies adjacent the resonator.

13. The apparatus of claim 12, wherein the extent of the stub beyond the ground plate is less than $\lambda_{res}$.

14. The apparatus of claim 13, wherein the extent of the stub beyond the ground plate is less than one-fourteenth of $\lambda_{res}$.

15. The apparatus of claim 1, wherein the resonator has negative electrical permittivity when excited at the resonant frequency.

16. The apparatus of claim 1, further comprising a source of radiofrequency signals for transmission, said source coupled to the transmission line so as to excite the antenna via said transmission line.

17. The apparatus of claim 1, further comprising a radiofrequency receiver circuit coupled to the transmission line so as to receive radiofrequency signals from the antenna via said transmission line.

* * * * *